US005770932A

United States Patent [19]

Nakane

[11] Patent Number: 5,770,932

[45] Date of Patent: Jun. 23, 1998

[54] CONVERGENCE CORRECTING DEVICE

[75] Inventor: Takayuki Nakane, Kyoto, Japan

[73] Assignee: Mitsubishi Denki Kabushiki Kaisha, Tokyo, Japan

[21] Appl. No.: 517,677

[22] Filed: Aug. 22, 1995

[30] Foreign Application Priority Data

Jan. 31, 1995 [JP] Japan ..... 7-014018
Mar. 8, 1995 [JP] Japan ..... 7-048297

[51] Int. Cl.[6] ..... H01J 29/70

[52] U.S. Cl. ..... 313/412; 313/431; 313/440

[58] Field of Search ..... 313/412, 413, 313/431, 437, 440; 335/210, 212

[56] References Cited

U.S. PATENT DOCUMENTS 4,218,667 8/1980 Barkow et al. .
4,245,205 1/1981 Wardell, Jr. .
5,182,487 1/1993 Ohtsu ..... 313/440
5,432,401 7/1995 Satoh et al. ..... 313/440

FOREIGN PATENT DOCUMENTS 52-100840 8/1977 Japan .
59-6026 2/1984 Japan .

*Primary Examiner*—Sandra L. O'Shea
*Assistant Examiner*—Vip Patel
*Attorney, Agent, or Firm*—Birch, Stewart, Kolasch & Birch, LLP

[57] ABSTRACT

A convergence correcting device movable in the direction of horizontal deflection axis comprising a first pair of magnetic pieces disposed at a specific interval on both sides of electron beams on the horizontal deflection axis, and a second pair of magnetic pieces disposed at a specific interval on both sides of the electron beams on a vertical deflection axis. These magnetic pieces are disposed between a deflection yoke and a subsidiary yoke. In this simple structure, the YV axis deviation due to correction of XH axis deviation can be canceled, and by setting the intervals of the first and second pair of magnetic pieces at proper values, the XH axis deviation can be easily corrected to a practically ignorable level without causing YV axis deviation.

15 Claims, 17 Drawing Sheets

FIG. 22 PRIOR ART
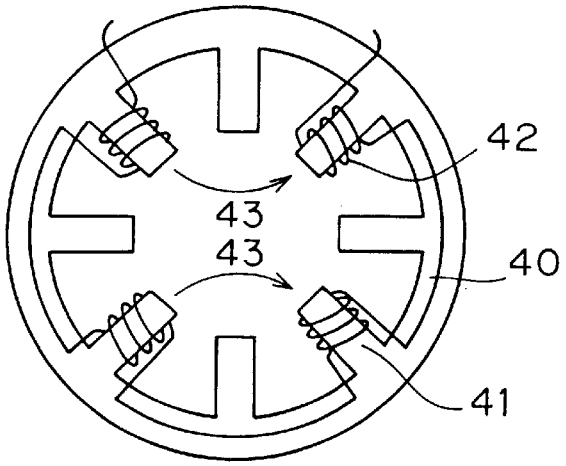
FIG. 23 PRIOR ART
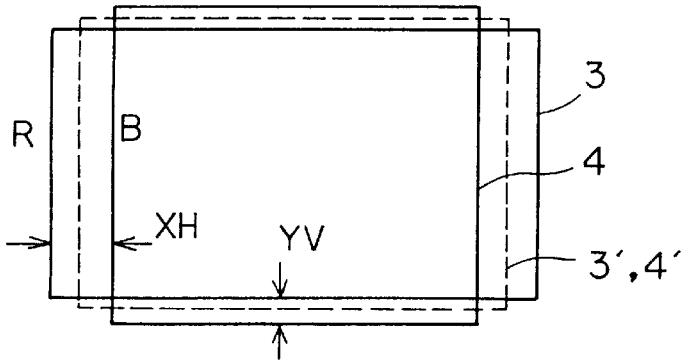
FIG. 24A PRIOR ART
FIG. 24B PRIOR ART
FIG. 24C PRIOR ART
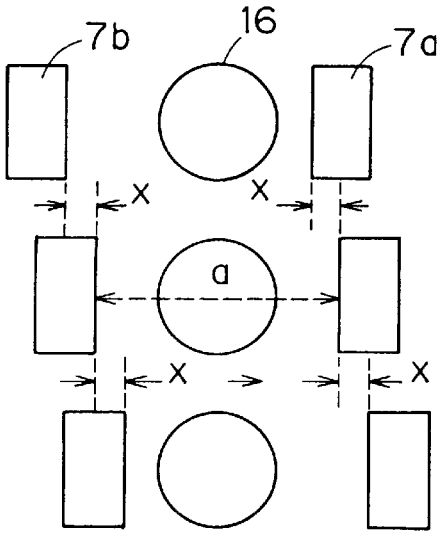
MAGNETIC PIECE INTERVAL : a mm
MOVABLE RANGE : ±x mm (=±2.5 mm FIXED)

CONVERGENCE CORRECTING DEVICE

BACKGROUND OF THE INVENTION

1. Field of the Invention

The present invention relates to a color image display device using an inline type color picture tube, and more particularly to its convergence correcting device.

2. Description of the Background Art

A color image display device using an inline type color picture tube forms a screen by deflecting three electron beams of R (red), G (green), and B (blue), emitted from inline electron guns arranged in a row along the horizontal deflection axis, in horizontal and vertical directions through the use of deflection yokes.

Of course, the three electron beams must be concentrated on a single point of the fluorescent screen, but generally the distance from the deflection center differs between the center of the screen and other parts, and the degree of concentration of beam at different positions on the screen varies, which causes the convergence to deviate.

An improved deflection yoke with self-convergence correction is proposed for improving this problem. This improvement is realized by use of a deflection yoke having the horizontal deflection magnetic field in pincushion magnetic field and the vertical deflection magnetic field in barrel magnetic field.

In recent color image display devices, there is a strong demand for higher resolution and higher density, and it is difficult to meet this demand with the self-convergence correction, and deflection yokes with additional convergence correcting devices such as subsidiary yoke using a multipolar core have been devised.

FIG. 14 shows an example. An inline type color picture tube 15 has a neck 16 equipped with an electron gun for generating three electron beams 2. The neck 16 is also furnished with a deflection yoke 9 and a subsidiary yoke 40 as a convergence correcting device.

The subsidiary yoke 40 comprises an 8-pole core 41 composed of, for example, ferrite, permalloy, or silicon steel plate. The 8-pole core 41 performs coma correction and static convergence correction. In particular, by adding a vertical coma correcting coil 42 to the 8-pole core 41, vertical coma may be corrected by passing a correction current through the vertical coma correcting coil 42.

The shape of the core of the subsidiary yoke 40 may be also in C-form or E-form, aside from 8-pole form.

As herein described, coma correction corrects the phenomenon of decrease of vertical deflection amount of the electron beam of G (green) to the electron beams of R (red) and B (blue) at the upper and lower ends of the screen because the vertical deflection coil forms a barrel magnetic field.

FIG. 15 is a circuit diagram for explaining the vertical coma correction. By passing a vertical deflection current through the vertical coma correcting coil 42, a pincushion magnetic field 43 is formed at the end of the electron gun side of the deflection yoke 9, and the coma is corrected.

In such deflection yoke 9 with self-convergence correction, it is necessary to correct the convergence axis deviation. The convergence axis deviation is the deviation of convergence when the distribution of the vertical or horizontal deflection magnetic field is imbalanced vertically or laterally with respect to the electron beams.

The convergence axis deviation is generally corrected by inclining the opening of the deflection yoke 9 (the opposite side of the electron gun) vertically or laterally-along the horizontal deflection axis or vertical deflection axis.

FIG. 16A and FIG. 16B are diagrams showing the lateral imbalance of the distribution of horizontal deflection magnetic field 1 and the accompanying deviation of convergence. FIG. 16A shows the case of lateral imbalance of the 5 horizontal deflection magnetic field 1 with respect to the electron beam 2, and FIG. 16B shows the deviation of convergence of vertical lines at right and left ends of red raster 3 and blue raster 4 on the screen of the inlinetype color picture tube 15, that is, the XH axis deviation, occurring when lateral imbalance of the horizontal deflection magnetic field 1 is present as shown in FIG. 16A. It is assumed, however, that the red raster 3' and blue raster 4' before onset of lateral imbalance of the horizontal deflection magnetic field 1 have been matched. As a matter of course, when the lateral imbalance of the distribution of the horizontal deflection magnetic field 1 occurs in the opposite direction of that illustrated in FIG. 16A, the XH axis deviation is in reverse direction of that illustrated in FIG. 16B.

To correct such XH axis deviation, the opening of the deflection yoke 9 is inclined to the right or left of the horizontal deflection axis to cancel the lateral imbalance of distribution of the horizontal deflection magnetic field 1. For example, when the XH axis deviation of FIG. 16B occurs, it is evident that the XH axis deviation can be corrected by inclining the opening of the deflection yoke 20 9 to the right side.

However, by inclining the deflection yoke 9 to right or left of the horizontal deflection axis, the convergence in other positions than the correcting position also changes, and it is further known that the distortion is also changed.

FIG. 17A shows a lateral imbalance of distribution of the vertical deflection magnetic field 5 which occurs by inclining the deflection yoke 9 right or left. FIG. 17B shows the deviation of convergence occurring due to an imbalance of distribution of the vertical deflection magnetic field 5 shown in FIG. 17A, and FIG. 17C shows a change in raster distortion.

When the opening of the deflection yoke 9 is inclined to the left, the 5 horizontal deflection magnetic field 1 and vertical deflection magnetic field 5 are imbalanced laterally as shown in FIG. 16A and FIG. 17A with respect to the electron beam 2. In this case, as compared with the case of not inclining the opening of the deflection yoke 9 right or left (the red raster 3' and blue raster 4' are matched), the convergence is as shown in FIG. 17B, that is, the red raster 3 is expanded both vertically and laterally with respect to the blue raster 4. Meanwhile, the distortion change (or the change of green raster 6) when the opening of the deflection yoke 9 is not inclined right or left is expanded to the left as shown in FIG. 17C. When the opening of the deflection yoke 9 is inclined to the right side, the change is opposite to FIG. 17B and FIG. 17C.

Thus, the cause of deviation (YV axis deviation) in the convergence of lateral lines at upper and lower ends of the red raster 3 and blue raster 4 is the lateral imbalance occurring in the distribution of the vertical deflection magnetic field 5, and the cause of lateral imbalance in the distribution of the vertical deflection magnetic field 5 is the inclination of the deflection yoke 9. That is, when the deflection yoke 9 is inclined right or left to correct for the XH axis deviation, structurally, the distribution is changed not only in the horizontal deflection magnetic field 1 but also in the vertical deflection magnetic field 5, with respect to the electron beam, and hence the YV axis deviation also occurs.

Change of the magnetic field distribution mainly at the opening side of the deflection yoke 9 also has a significant effect on the distortion. That is, when the deflection yoke 9 is inclined to right or left, the distortion is also changed.

To solve this problem, a magnetic piece is adhered to the end portion of the electron gun side of the deflection yoke 9, or a deflection yoke comprising a conversion correcting device with a movable magnetic piece is used. Using such convergence correcting device, it is not necessary to incline the deflection yoke to right or left.

FIG. 18A shows a schematic structure of an embodiment of a convergence correcting device 8 for correction of XH axis deviation by using a magnetic piece, and FIG. 18B shows the changes of distribution of horizontal deflection magnetic field 1 by using the convergence correcting device 8.

FIG. 18A is drawn in a direction of observing the deflection yoke 9 side from the neck 16 side of the inline type color picture tube 15. In the convergence correcting device 8, a pair of magnetic pieces 7*a*, 7*b* are disposed so that the electron beam 2 is disposed therebetween, that is, the neck 16 comprising the electron gun is between magnetic pieces 7*a*, 7*b*. In the convergence correcting device 8, an elliptical hole 11 is opened, in which the neck 16 is inserted. The convergence correcting device 8 is movable along the horizontal deflection axis.

For example, as shown in FIG. 18B, when the pair of magnetic pieces 7*a*, 7*b* are shifted to the right side as seen from the tube surface, it produces a lateral 20 imbalance of the horizontal deflection magnetic field 1 as if the opening of the deflection yoke 9 were inclined to the left. Accordingly, as compared with the case of the magnetic pieces 7*a*, 7*b* staying at symmetrical positions to the tube axis, a convergence change occurs as shown in FIG. 16B. Similarly, when the magnetic pieces 7*a*, 7*b* are moved in the opposite direction of FIG. 18B, the convergence 25 change is opposite to FIG. 16B.

Thus, when the pair of magnetic pieces 7*a*, 7*b* are used for the purpose of correction of convergence, it is not necessary to incline the deflection yoke 9, and lateral imbalance hardly occurs in the distribution of vertical deflection magnetic field 5. Therefore, there is almost no effect on the YV axis deviation, and since the convergence correcting device 8 functions at the electron gun side end of the deflection yoke 9, there is almost no effect on the distortion.

It is very natural herein to consider the combination of the subsidiary yoke 40 and the convergence correcting device 8 holding the pair of magnetic pieces 7*a*, 7*b*. But by mere combination of them, the following problems were found to be present as a result of experiment in the manufacture of trial products.

Background Art 1

A subsidiary yoke 40 was composed of an 8-pole core 41 made of ferrite of 68 mm in diameter and 8 mm in thickness, and it was placed at a position of about 10 mm behind (to the opposite side of the tube surface) from the horizontal deflection coil provided in the deflection yoke. The 8-pole core 41 was not provided with vertical coma correcting coil 42. An object of high magnetic permeability was present behind the deflection yoke 9.

The magnetic pieces 7*a*, 7*b* were prepared in each pair of three different sizes of ferrite thin plates (thickness 1 mm) (30×5, 22×4, 16×3 mm). The magnetic 20 pieces 7*a*, 7*b* were arranged at a position of 6 mm from the horizontal deflection coil between the horizontal deflection coil of the deflection yoke 9 and the 8-pole core 41, so that their effect would not be shielded by the 8-pole core 41.

In the above condition, in order to correct the XY axis deviation, when the magnetic pieces 7*a*, 7*b* are moved, for example, to the right as seen from the tube surface same as in FIG. 18B, the YV axis deviation is also changed as shown in FIG. 19. When the magnetic pieces 7*a*, 7*b* are moved to the left, as a matter of course, the change of convergence is opposite to FIG. 19.

This is caused by complication of the distribution of the vertical deflection magnetic field as the leakage magnetic field from the deflection yoke 9 to the electron gun side is shielded by the 8-pole core 41 composing the subsidiary yoke 40 disposed at the electron gun side end of the deflection yoke 9. If the deflection yoke 9 does not possess a subsidiary yoke 40, the distribution of vertical deflection magnetic field is hardly influenced by the position of the magnetic pieces 7*a*, 7*b*. However, since the subsidiary yoke 40 is present, the distribution of the vertical deflection magnetic field is influenced by the position of the magnetic pieces 7*a*,7*b* and the distribution of the vertical deflection magnetic field is imbalanced laterally, which causes YV axis deviation.

This phenomenon was measured only in the above condition (that is, in a deflection yoke 9 having subsidiary yoke 40 comprising 8-pole core), but it seems to be a phenomenon which also exists when an object of high magnetic permeability containing E-form or C-form core is present behind the deflection yoke 9 (although the amount of YV axis deviation may be different).

In the above condition, changes of XH axis deviation and YV axis deviation were measured in the parameters of the size of the magnetic pieces 7*a*, 7*b* and the moving range (+x [mm]) and interval (2x+33 [mm]). FIG. 20A shows an example of positioning the pair of magnetic pieces 7*a*, 7*b* at equal distance on both sides of the neck 16, FIG. 20B illustrating the positioning of the magnetic pieces 7*a*, 7*b* at the remotest and closest distances to the neck 16, respectively, and FIG. 20C shows a case of positioning the magnetic pieces 7*a*, 7*b* at the closest and remotest distances to the neck 16, respectively.

Table 1 shows the size of the magnetic pieces 7*a*, 7*b* and changes of XH axis deviation and YV axis deviation obtained by their position, and FIG. 21 is a plotting thereof.

TABLE 1

| Size of Magnetic Pieces | Moving Range (x) ±0 mm | ±1 mm | ±2 mm | ±3 mm | ±4 mm | ±5 mm |
|---|---|---|---|---|---|---|
| 30 × 5 mm | | | | | | |
| XH | 0.00 | 0.55 | 0.08 | 0.88 | 0.96 | 0.89 |
| YV | 0.00 | 0.03 | 0.06 | 0.10 | 0.10 | 0.12 |
| 23 × 4 mm | | | | | | |
| XH | 0.00 | 0.34 | 0.55 | 0.69 | 0.72 | 0.60 |
| YV | 0.00 | 0.00 | 0.01 | 0.02 | 0.03 | 0.03 |
| 16 × 3 mm | | | | | | |
| XH | 0.00 | 0.25 | 0.34 | 0.37 | 0.54 | 0.51 |
| YV | 0.00 | 0.00 | 0.00 | 0.00 | 0.01 | 0.01 |

Unit: mm

It is known from FIG. 21 that the changing amount of XH axis deviation and W axis deviation increases as the size of the magnetic pieces 7*a*, 7*b* and the moving range increase.

To correct the XH axis deviation, a convergence change of about 0.8 mm or more is required, and for this purpose, therefore, the largest magnetic pieces (30×5 mm) must be used, and the moving range is required over ±2 mm. At this time, the change of YV axis deviation is about 0.1 mm. This change of YV axis deviation is not an ignorable value, which causes to disturb the quality of convergence.

Background art 2

At the electron gun side of the deflection yoke 9, a ferrite 8-pole core 41 of 90 mm in diameter and 5 mm in thickness is provided, and a vertical coma correcting coil 42 was wound as shown in FIG. 22.

As a pair of magnetic pieces 7*a*, 7*b* disposed in the convergence correcting 15 device 8, a pair of thin ferrite plates (30×5 mm, 1 mm thick) were used. The pair of magnetic pieces 7*a*, 7*b* were arranged at a position 3 mm remote from the 8-pole core 41 between the horizontal deflection coil of the deflection yoke 9 and the 8-pole core 41 so that their effect may not be shielded by the 8-pole core 41.

In the above conditions, to correct the XH axis deviation, for example, when the magnetic pieces 7*a*, 7*b* are moved to the right as seen from the tube surface in the same manner as illustrated in FIG. 18B, it is accompanied by a phenomenon of changing also the YV axis deviation as shown in FIG. 23. Of course, when the magnetic pieces 7*a*, 7*b* are moved to the left, the change of convergence deviation is opposite to FIG. 23.

This is because the distribution of the vertical coma correction magnetic field 43 is imbalanced laterally by changing the position of the magnetic pieces 7*a*, 7*b*, thereby breaking the balance of the deflection amount of each beam of R (red) and B (blue).

This phenomenon was measured only in the above condition (that is, in the vertical coma correcting coil wound on the 8-pole core as specified above), but it seems to be a phenomenon similarly present in vertical coma correction using the vertical coma correcting coil wound on E-form or C-form core.

In the above condition, changes of XH axis deviation and YV axis deviation were measured in the parameter of the interval a of the magnetic pieces 7*a*, 7*b*. The moving range was fixed at ±2.5 [mm].

FIG. 24A shows a case of positioning the magnetic pieces 7*a*, 7*b* at closest and remotest distance to the neck 16, respectively, FIG. 24B shows a case of positioning the pair of magnetic pieces 7*a*, 7*b* at equal distance on both sides of the neck 16, and FIG. 24C shows a case of positioning the magnetic pieces 7*a*, 7*b* at remotest and closest distance to the neck 16, respectively.

Table 2 shows the changes of XH axis deviation and YV axis deviation obtained by the interval of the magnetic pieces 7*a*, 7*b*, and FIG. 25 is a plotting thereof.

TABLE 2

| | | Magnetic Piece Interval (a) | | | |
|---|---|---|---|---|---|
| Size of Magnetic Pieces | | 40 mm | 45 mm | 50 mm | 55 mm |
| 30 × 55 mm | XH | 1.30 | 0.80 | 0.40 | 0.20 |
| | YV | 0.33 | 0.12 | 0.03 | 0.00 |

Unit: mm

It is known from FIG. 25 that the XH axis deviation and YV axis deviation increase as the interval a of the magnetic pieces 7*a*, 7*b* is smaller.

To correct the XH axis deviation, a convergence change of about 0.8 mm or 10 more is required, and for this purpose, therefore, the interval a of the magnetic pieces 7*a*, 7*b* must be 45 mm or less. At this time, the change of YV axis deviation is about 0.1 mm to 0.3 mm or more. This change of YV axis deviation cannot practically be ignored, since it causes a noticeable disturbance in the quality of the convergence of the color image display device.

As mentioned herein, in the conventional color image display device merely combining the 8-pole core 41 having subsidiary yoke 40 and the convergence correcting device 8 holding a pair of magnetic pieces 7*a*, 7*b* in order to correct XH axis deviation, it was difficult to control the changing amount of the YV axis deviation within a proper range while retaining the necessary correction amount of the XH axis deviation. The problem is the same also in the case of a winding vertical coma correcting coil 42 wound around the subsidiary yoke 40.

SUMMARY OF THE INVENTION

A first aspect of the invention relates to a convergence correcting device for correcting convergence of a color image display device comprising a color picture tube having an inline type electron gun for generating three electron beams along a horizontal deflection axis, a deflection yoke for deflecting the electron beams along the horizontal deflection axis and a vertical deflection axis, and a subsidiary yoke composed of a multipolar core, disposed at the electron gun side of the deflection yoke. It further comprises a first pair of magnetic pieces movable along the horizontal deflection axis while mutually keeping a first interval, aligned with the electron gun on the horizontal deflection axis, and a second pair of magnetic pieces movable along the horizontal deflection axis while mutually keeping a second interval, aligned on the vertical deflection axis. Herein, the two distances from one and the other of the second pair of magnetic pieces to the electron gun are mutually equal, if moving along the horizontal deflection axis, so that a relative configuration of the first and second pairs of magnetic pieces may be maintained.

In the convergence correcting device according to the first aspect of the invention, the first pair of magnetic pieces correct the XH axis deviation. The second pair of magnetic pieces cancel the YV axis deviation caused by this correction of XH axis deviation.

Therefore, by properly setting the first and second intervals, when correcting the convergence deviation due to lateral imbalance of either the distribution of the vertical deflection magnetic field or the distribution of the horizontal deflection magnetic field, the effect on the other magnetic field distribution may be suppressed to a practically ignorable level.

A second aspect conforms to the convergence correcting device of the first aspect, which further comprises a base body on which the first pair of magnetic pieces are mounted at the first interval, and the second pair of magnetic pieces are mounted at the second interval, and a handle attached to the base body. This base body is movable along the horizontal deflection axis.

Therefore, the adjustment work for correction by the convergence correcting device is easy.

A third aspect conforms to the convergence correcting device of the second aspect, which further comprises fixing means for fixing the base body at a desired position in a moving range along the horizontal deflection axis.

Therefore, the convergence correcting device can be easily fixed at an optimum position after convergence correction, and the adjustment work for correction by the convergence correcting device is easier.

A fourth aspect confirms to the convergence correcting device of the first aspect, in which the first pair of magnetic pieces are composed of ferrite material.

Therefore, being applicable to a horizontal deflection magnetic field of high frequency, an excellent covergence correction is achieved.

A fifth aspect conforms to the convergence correcting device of the first a spect, in which the second pair of magnetic pieces are composed of silicon steel plate.

In the convergence correcting device according to the fifth aspect, a high frequency characteristic is not required in the second pair of magnaetic pieces. Therefore, even by using silicon steel plate, the convergence can be corrected, and the convergence correcting device can be realized at low cost.

A sixth aspect conforms to the convergence correcting device of the first aspect, in which the first pair of magnetic pieces are long along the vertical deflection axis.

Therefore, the first pair of magnetic pieces may have a great effect on the horizontal deflection magnetic field generated along the vertical deflection axis.

A seventh aspect conforms to convergence correcting device of the first aspect, in which the second pair of magnetic pieces are long along the horizontal deflection axis.

Therefore, the second pair of magnetic pieces may have a great effect on the vertical deflection magnetic field generated along the horizontal deflection axis.

An eighth aspect conforms to the convergence correcting device of the first aspect, in which the convergence correcting device is disposed between the deflection yoke and the subsidiary yoke.

A ninth aspect relates to a convergence correcting device for correcting convergence of a color image display device comprising a color picture tube having inline type electron gun for generating three electron beams along a horizontal deflection axis, a deflection yoke for deflecting the electron beams along the horizontal deflection axis and a vertical deflection axis, and a subsidiary yoke composed of a multipolar core, disposed at the electron gun side of the deflection yoke. It further comprises a pair of magnetic pieces movable along the horizontal deflection axis while mutually keeping a specific interval, aligned with the electron gun on the horizontal deflection axis, and a set of four magnetic pieces movable along the horizontal deflection axis, being disposed on each apex of a rectangle having a first pair of sides parallel to the vertical deflection axis, and a second pair of sides parallel to the horizontal deflection axis. Herein the two distances from the one and the other of the pair of magnetic pieces disposed at both ends of the first sides to the electron gun are mutually equal, if moving along the horizontal deflection axis, so that a relative configuration of the pair of magnetic pieces and the set of magnetic pieces may be maintained.

In the convergence correcting device according to the ninth aspect of the invention, the pair of magnetic pieces correct the XH axis deviation. The set of magnetic pieces cancel the YV axis deviation caused by this correction of XH axis deviation.

Therefore, by properly setting the specific interval and shape of the rectangle, when correcting the convergence deviation due to lateral imbalance of either distribution of vertical deflection magnetic field or distribution of horizontal deflection magnetic field, the effect on the other magnetic field distribution may be suppressed to a practically ignorable level.

A tenth aspect conforms to the convergence correcting device of the ninth aspect, in which a vertical coma correcting coil is wound on the subsidiary yoke.

In the convergence correcting device according to the tenth aspect, the convergence deviation can be corrected favorably also in the case of vertical coma correction.

An eleventh aspect conforms to the convergence correcting device of the tenth aspect, which further comprises a base body on which the pair of magnetic pieces are mounted at the specific interval, and the set of magnetic pieces mounted on the position of each apex of the rectangle, and a handle attached to the base body. This base body is movable along the horizontal deflection axis.

Therefore, the adjustment work for correction by the convergence correcting device is easy.

A twelfth aspect conforms to the convergence correcting device of the tenth aspect, in which the pair of magnetic pieces are composed of ferrite material.

Therefore, being applicable to a horizontal deflection magnetic field of high frequency, an excellent convergence correction is achieved.

A thirteenth aspect conforms to the convergence correcting device of the tenth aspect, in which the set of magnetic pieces are composed of silicon steel plate.

In the convergence correcting device according to the thirteenth aspect, a high frequency characteristic is not required in the set of magnetic pieces. Therefore, even by using silicon steel plate, the convergence can be corrected, and the convergence correcting device can be realized at low cost.

A fourteenth aspect conform to the convergence correcting device of the tenth aspect, in which the pair of magnetic pieces are long along the vertical deflection axis.

Therefore, the first of magnetic pieces may have a great effect on the horizontal deflection magnetic field generated along the vertical deflection axis.

A fifteenth aspect conforms to convergence correcting device of the tenth aspect, in which the set of magnetic pieces are long along the horizontal deflection axis.

Therefore, the set of magnetic pieces may have a great effect on the vertical deflection magnetic field generated along the horizontal deflection axis.

A sixteenth aspect conforms to the convergence correcting device of the tenth aspect, in which the convergence correcting device is disposed between the deflection yoke and the subsidiary yoke.

It is therefore an object of the present invention to provide a convergence correcting device for color image display device capable of correcting the XH axis deviation without causing YV axis deviation in a simple structure.

This and other objects, features, aspects and advantages of the present invention will become more apparent from the following description of the present invention when taken in conjunction with the accompanying drawings.

BRIEF DESCRIPTION OF THE DRAWINGS

FIG. 22 shows a mode of winding of vernical coma correcting coil in a background art example two.

FIG. 23 shows deviation of convergence in the background art example two.

FIG. 24A to FIG. 24C show measuring modes of convergence deviation in the background art example two.

DESCRIPTION OF THE PREFERRED EMBODIMENTS

A. When a correcting coil is not wound on a subsidiary yoke:

Preferred embodiment 1

Figure 1:
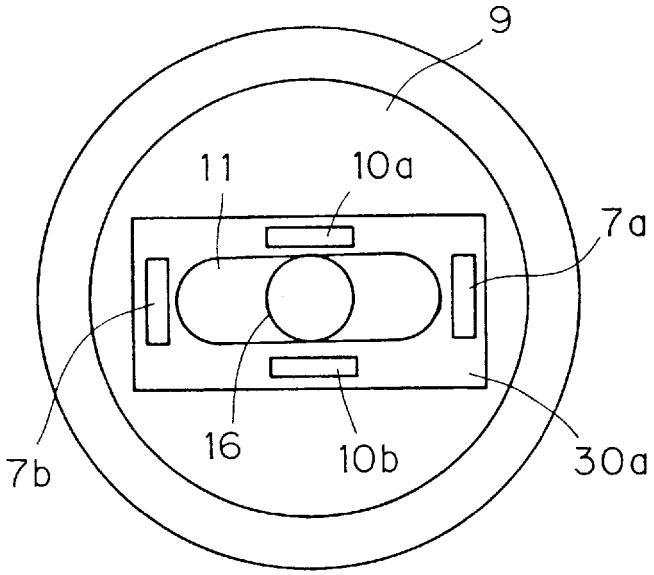
FIG. 1 is a front view showing a schematic arrangement of preferred embodiment 1 of the invention.
Figure 2:
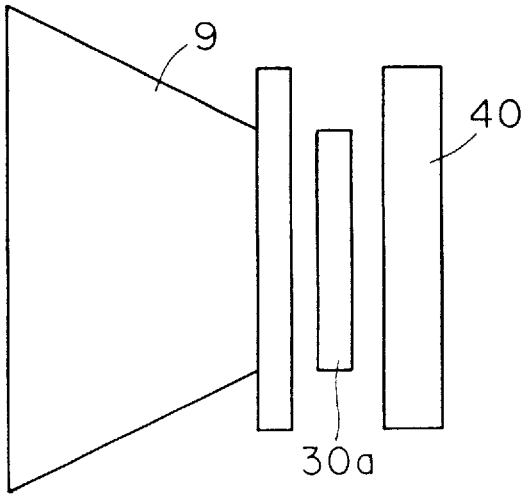
FIG. 2 is a side view showing a schematic arrangement of preferred embodiment 1 of the invention.

FIG. 1 is a front view showing a preferred embodiment of a convergence correcting device according to the invention, which is a schematic structural diagram as seen from the neck 16 side. FIG. 2 is a diagram observing the arrangement in FIG. 1 from a lateral side.

Before executing the preferred embodiment 1 shown in FIG. 1 and FIG. 2, as a method of solving the problems in the background arts, it was attempted to see what would happen if only a pair of magnetic pieces 10*a*, 10*b* for YV axis deviation correction were disposed, without disposing a pair of magnetic pieces 7*a*, 7*b* for XH axis deviation correction on the convergence correcting device 8 intended to correct XH axis deviation (first preliminary stage art).

Figure 3A:
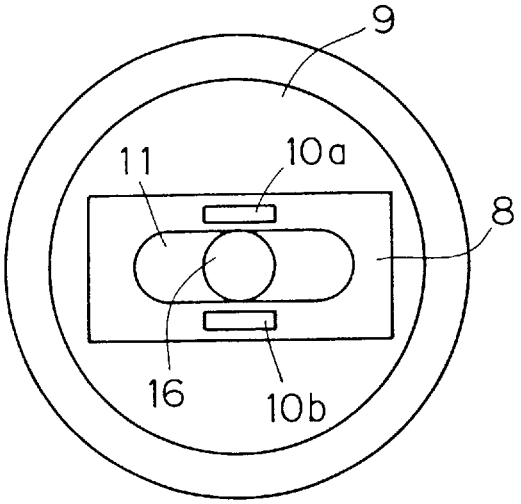
FIG. 3A is a front view showing a schematic arrangement of a first preliminary stage art.

FIG. 3A is a front view showing a case of disposing the pair of magnetic pieces 10*a*, 10*b* for YV axis deviation correction. In the subsidiary yoke 40, however, a vertical coma correcting coil 42 is not wound.

The YV axis deviation is caused by lateral imbalance of distribution of a vertical deflection magnetic field 5. Therefore, to correct the YV axis deviation by magnetic pieces, in the same manner as in correction of XH axis deviation, the pair of magnetic pieces 10*a*, 10*b* are disposed so as to locate the electron beams between them on the vertical deflection axis as shown in FIG. 3A, and the convergence correcting device 8 capable of moving the pair of magnetic pieces 10*a*, 10*b* right and left along the horizontal deflection axis is disposed at the electron gun side end of the deflection S yoke 9. If moved right or left along the horizontal deflection axis, the distance from the magnetic piece 10*a* to the electron gun, and the distance from the magnetic piece 10*b* to the electron gun are always equal to each other.

Figure 3B:
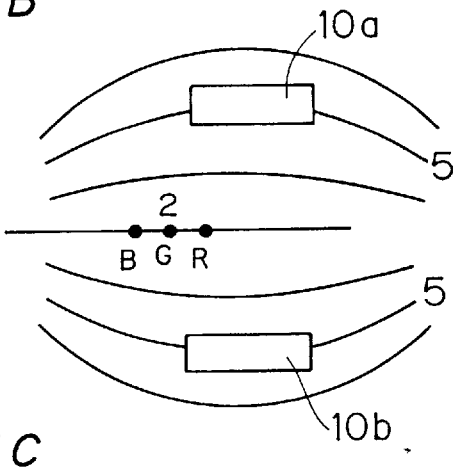
FIG. 3B shows distribution of vertical deflection magnetic field in the first preliminary stage art.
Figure 3C:
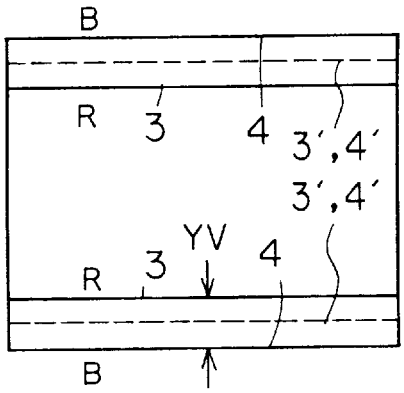
FIG. 3C shows deviation of convergence in the first preliminary stage art.

For example, when the pair of magnetic pieces 10*a*, 10*b* are moved to the right side as seen from the tube surface as shown in FIG. 3B, a lateral imbalance occurs in the vertical deflection magnetic field S. and as compared with the case of the pair of magnetic pieces 10*a*, 10*b* existing at symmetrical positions to the electron beam with respect to the horizontal deflection axis (supposing the red raster 3' and blue raster 4' to have been matched), a YV axis deviation occurs as shown in FIG. 3C.

Figure 18A:
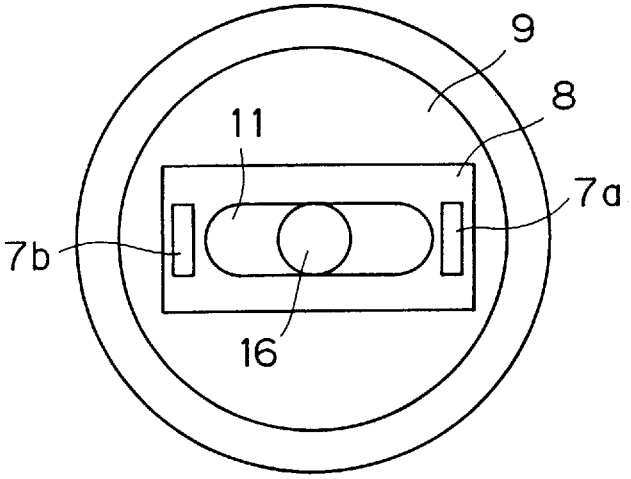
FIG. 18A PRIOR ART
FIG. 18A is a front view showing a schematic arrangement of the background art example one.
Figure 18B:
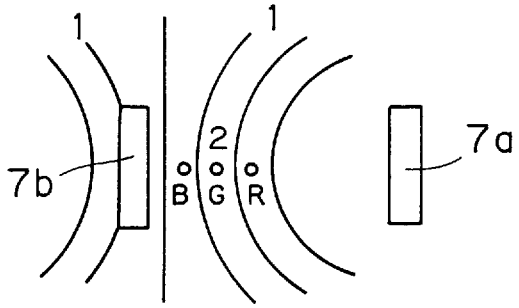
FIG. 18B PRIOR ART
FIG. 18B shows changes of distribution of horizontal deflection magnetic field.
Figure 19:
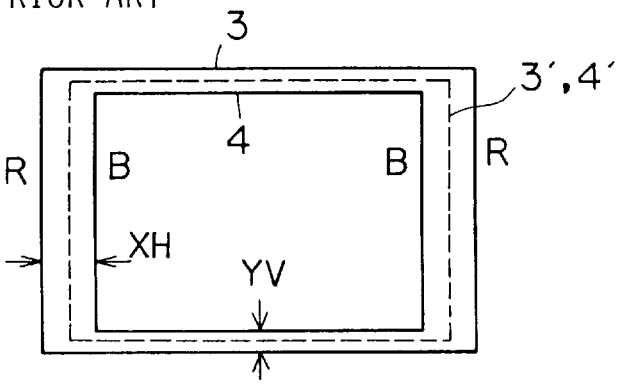
FIG. 19 PRIOR ART
FIG. 19 shows deviation of convergence in the background art example one.
Figures 20A, 20B, 20C:
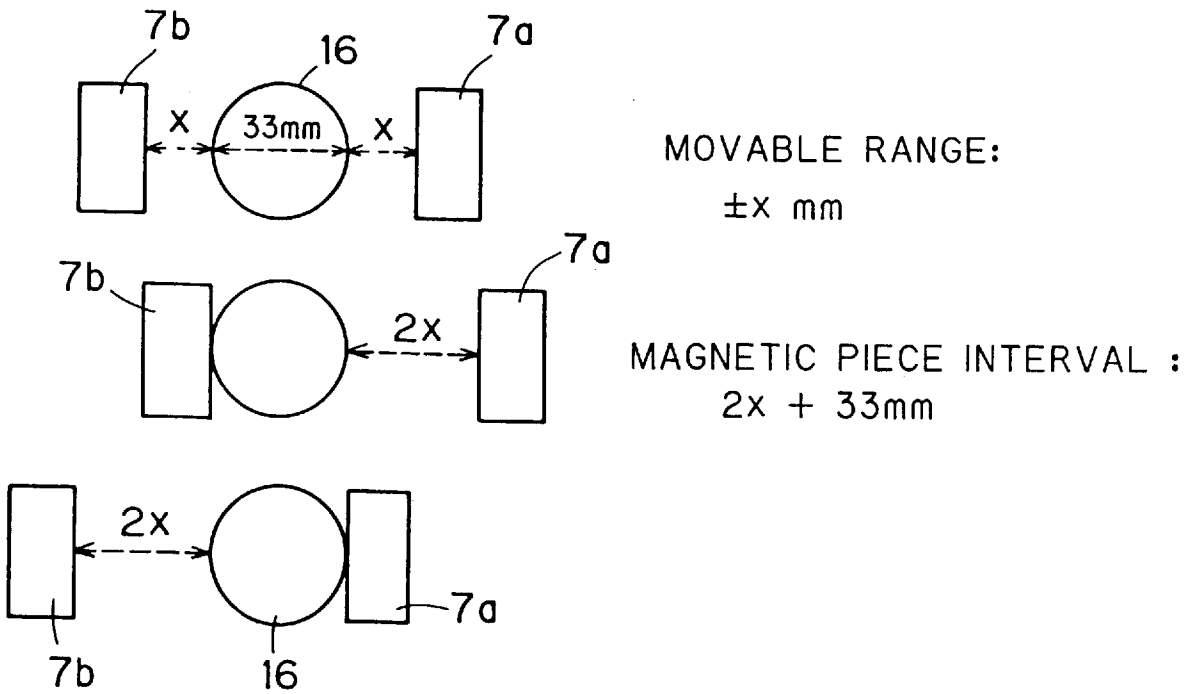
FIG. 20A PRIOR ART
FIG. 20B PRIOR ART
FIG. 20C PRIOR ART
FIG. 20A to FIG. 20C show measuring modes of convergence deviation in the background art example one.
Figure 21:
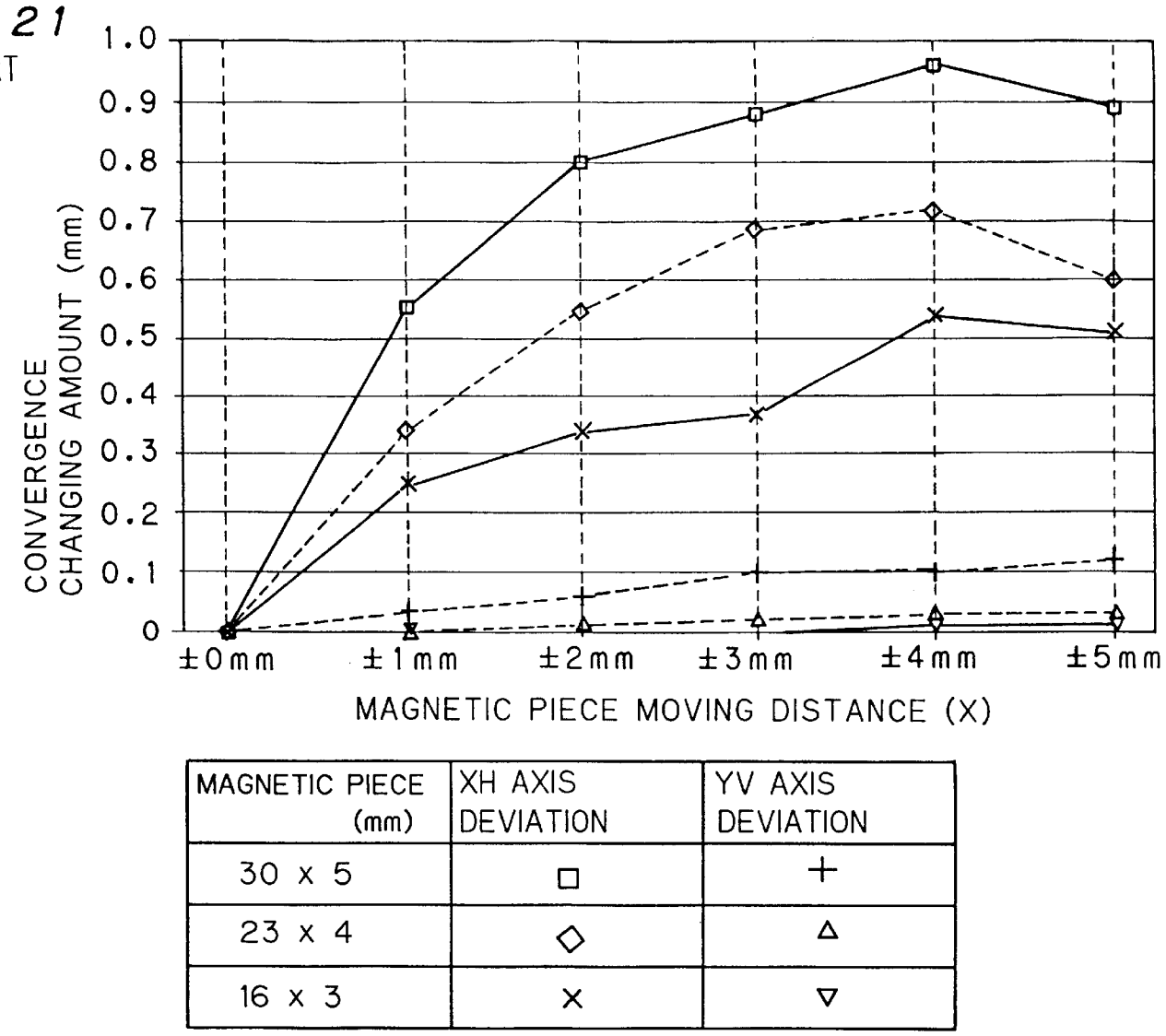
FIG. 21 PRIOR ART
FIG. 21 is a graph showing results of measurement of deviation of convergence in the background art example one.

A comparison is made between the relation of the change of YV axis deviation and moving direction of magnetic pieces 7*a*, 7*b* in conventional correction of XH axis deviation shown in FIGS. 18A, 18B and 19, and the relation of the change of W axis deviation and moving direction of magnetic pieces 10*a*,10*b* in cancellation of YV axis deviation shown in FIGS. 3A to 3C. That is, comparing FIG. 19 and FIG. 3C, when the moving directions of the magnetic pieces 7*a*, 7*b* and the moving direction of the magnetic pieces 10*a*, 10*b* are the same, the changes of YV axis deviation are in opposite directions.

It is therefore known that the constitution shown in FIG. 3A can be introduced as means for canceling the YV axis deviation accompanying XH axis deviation correction.

Herein, the effect of canceling the YV axis deviation by using the magnetic pieces 10*a*, 10*b* was confirmed in the same condition as in the measurement of XH axis deviation correction effect as shown in the background art example one (the specification, configuration, and magnetic piece inserting position in the subsidiary yoke 40 S having 8-pole core 41).

The pair of magnetic pieces 10*a*, 10*b* are made of two pieces of silicon steel plates (30×3 mm, 0.5 mm thick), the moving range a of magnetic pieces 10*a*, 10*b* is respectively ±3 mm and ±4 mm, and the magnetic piece position x was arranged as parameter. The interval of the magnetic pieces 10*a*, 10*b* is 2x+33[mm].

Figures 5A, 5B, 5C:
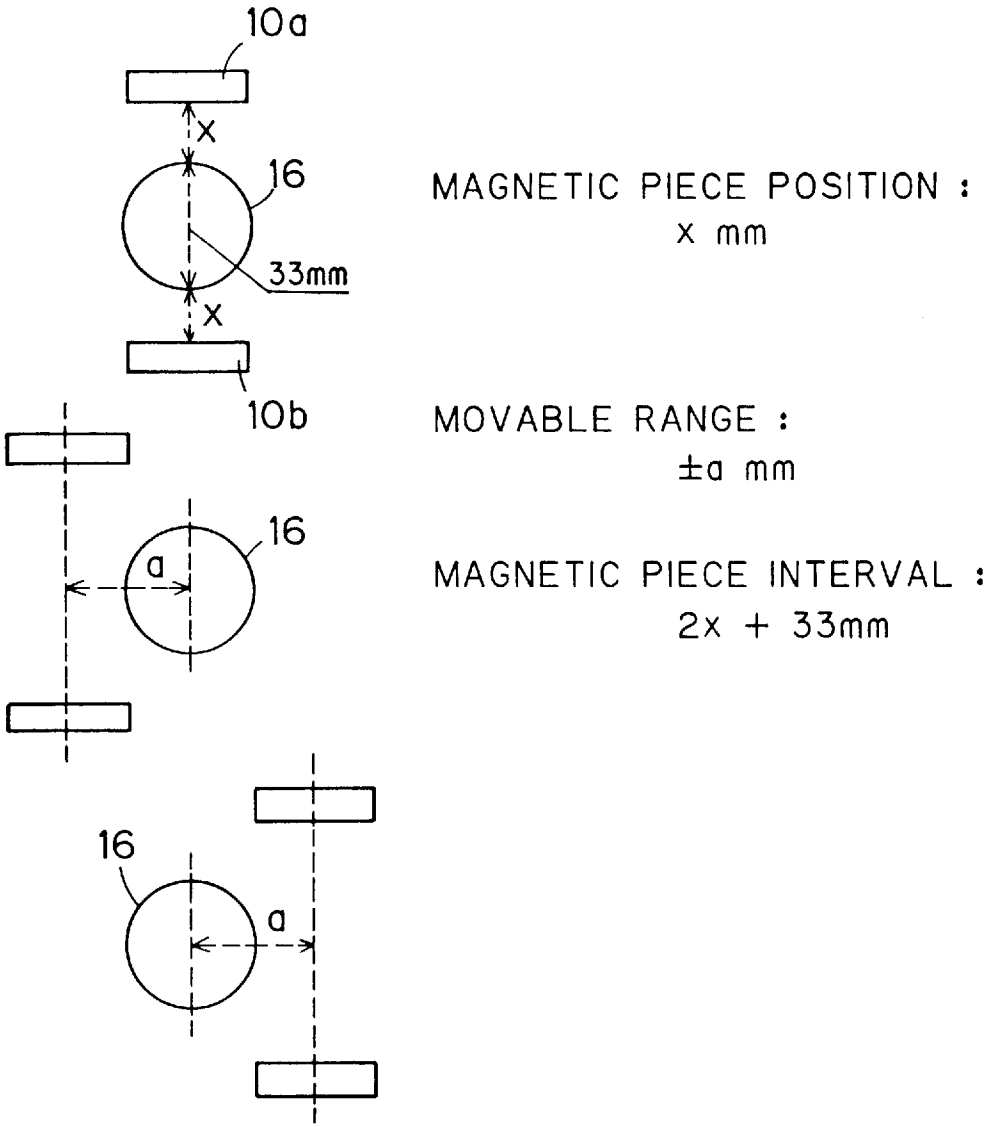
FIG. 5A to FIG. 5C show measuring modes of convergence deviation in the first preliminary stage art.

FIG. 5A shows the magnetic pieces 10*a*, 10*b* confronting both sides at the center of the neck 16, FIG. 5B at the leftmost side of the neck 16, and FIG. 5C at the rightmost side of the neck 16.

Figure 6:
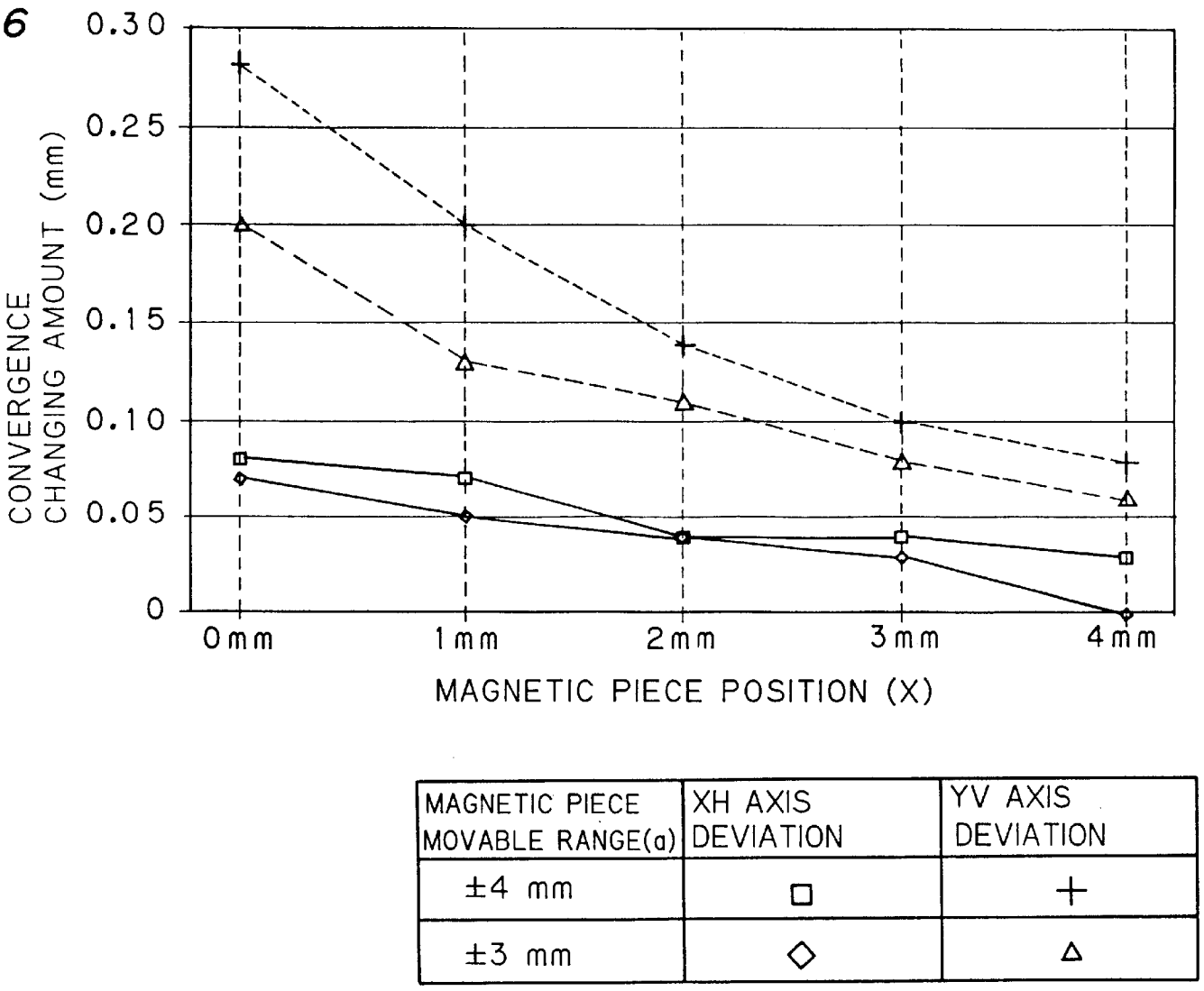
FIG. 6 is a graph showing results of measurement of deviation of convergence in the first preliminary stage art.

Table 3 shows the changing amount of convergence in terms of the position x and moving range a of the magnetic pieces 10*a*, 10*b*. FIG. 6 is plotting of the result in Table 3.

TABLE 3

| | Magnetic Piece Position (x) | | | | |
|---|---|---|---|---|---|
| Moving Range (a) | 0 mm | 1 mm | 2 mm | 3 mm | 4 mm |
| ±3 mm | | | | | |
| XH | 0.07 | 0.05 | 0.04 | 0.03 | 0.00 |
| YV | 0.20 | 0.13 | 0.11 | 0.08 | 0.06 |
| ±4 mm | | | | | |
| XH | 0.08 | 0.07 | 0.04 | 0.04 | 0.03 |
| YV | 0.28 | 0.20 | 0.14 | 0.10 | 0.08 |

Unit: mm

As known from Table 3 and FIG. 6, it is known that the correction amount of YV axis deviation and changing amount of XH axis deviation increase as the interval of the magnetic pieces 10*a*, 10*b* is narrower (x is smaller) and the moving range is wider (a is greater).

Figure 4:
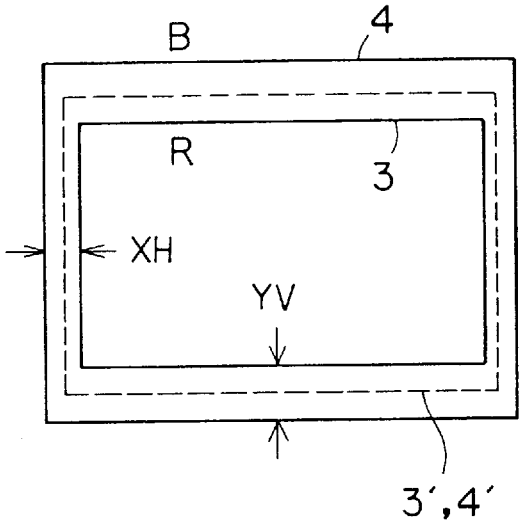
FIG. 4 shows a changing state of deviation of convergence in the first preliminary stage art.

The correction amount of YV axis deviation measured is the above condition is a change as shown in FIG. 4 when the magnetic pieces 10*a*, 10*b* are moved, for example, to the right as seen from the tube surface as shown in FIG. 3B, and the XH axis deviation also changes. However, as known from comparison of FIG. 19 and FIG. 4, the changing direction of the XH axis deviation when attempted to correct the YV axis deviation is reverse to the changing direction of the XH axis deviation when attempted to correct the XH axis deviation.

As explained in the background art 1, to correct the XH axis deviation, a convergence change of about 0.8 mm or more is needed, and to achieve it by using the magnetic pieces 7*a*, 7*b*, a change of about 0.1 mm occurs in the YV axis deviation. When it is canceled by the magnetic pieces 10*a*, 10*b*, it is known from FIG. 6 that the XH axis deviation is changed about O.OS mm. This is a very small value as compared with the amount of XH axis deviation to be corrected (0.8 mm), and there is almost no effect of decreasing the correction amount (it is rather not necessary to consider the decreasing amount if the correction amount of the XH axis deviation is set to a large value).

In the deflection yoke 9 having a multipolar core (for example, 8-pole core 41) in the rear part, as shown in FIG. 18A, the YV axis deviation is changed by the correction of XH axis deviation performed by disposing the magnetic pieces 7*a*, 7*b* on the convergence correcting device 8 movable on the horizontal deflection axis. It has been confirmed that this YV axis deviation can be effectively canceled by further disposing the magnetic pieces 10*a*, 10*b* on the convergence correcting device 8 so as to set the electron beams between them on the vertical deflection axis, and properly selecting the size of the magnetic pieces 10*a*, 10*b*, and distance from the horizontal deflection axis.

Referring back to FIG. 1 and FIG. 2, the preferred embodiment 1 of the invention is described below. In FIG. 1, the magnetic pieces 7*a*, 7*b* for XH axis deviation correction as first pair of magnetic pieces, and magnetic pieces 10*a*, 10*b* for YV axis deviation cancellation as second pair of magnetic pieces are disposed on a convergence correcting device 30*a* which is a same magnetic piece holding member.

In the convergence correcting device 30*a*, the neck 16 of the inline type color picture tube is inserted nearly in the middle, and a long slot 11 is provided in the horizontal deviation axial direction so as to be movable along the horizontal deviation axis.

Supposing the possible correction amount of the XH axis deviation to be 0.8 mm, when the movable range of the magnetic pieces (of the convergence correcting device 30*a* of the holding member of magnetic pieces) is too narrow, fine adjustment is difficult, and when too wide, it requires a wide space, and hence ±3 mm may be preferred.

To satisfy the above condition, considering the results of the measurement above, the magnetic pieces 7*a*, 7*b* for correction of XH axis deviation were rectangular ferrite plates of 30×5 mm and thickness of 1 mm, disposed at an interval of 39 mm, and magnetic pieces 10*a*, 10*b* for cancellation of YV axis deviation were rectangular silicon steel plates of 30×3 mm and thickness of 0.5 mm, disposed at an interval of 39 mm.

As for the magnetic pieces 7*a*, 7*b* for XH axis deviation, since it is intended to induce a lateral imbalance in the horizontal deflection magnetic field of high frequency, it is preferred to use a ferrite material of excellent frequency characteristic. It is hence applicable to the color image display device of multiscan system of high horizontal deflection frequency which is being developed recently. It is also preferred to be long in the direction along the horizontal deflection magnetic field (along the vertical deflection axis). It is for the purpose of giving 20 an effective effect on the horizontal deflection magnetic field.

As for the magnetic pieces 10*a*, 10*b* for cancellation of YV axis deviation, since it is intended to induce a lateral imbalance in the vertical deflection magnetic field of low frequency, the frequency characteristic is not demanded excessively, and hence a silicon steel plate is used. As a result, the YV axis deviation can be canceled at low cost. It is preferred to be long in the direction along the vertical deflection magnetic field (along the horizontal deflection axis). This is for giving an effective effect on the vertical deflection magnetic field.

Incidentally, nothing specific is mentioned about the mounting method of the magnetic pieces 7*a*, 7*b* for correction of XH axis deviation and magnetic pieces 5 lea, 1O*b* for cancellation of YV axis deviation on the convergence correcting device 30*a*, any method may be selected as long as fixing is secure.

The subsidiary yoke 40 comprising the 8-pole core 41 is disposed at the electron gun side from the convergence correcting device 30*a* as shown in FIG. 2, and its configuration is same as in the measuring condition explained in the background art example one (the interval of horizontal deflection coil and 8-pole core 41 is 10 mm, and the interval of magnetic pieces 7*a*, 7*b*, 10*a*, 10*b* and horizontal deflection coil is 6 mm).

The convergence correcting device 30*a* holding the magnetic pieces 7*a*, 7*b*, 10*a*, 10*b* has a hole 11 long (in the length of the desired moving range) in the horizontal deflection axial direction and having a width of about the outside diameter of the neck 16, and therefore lateral movement along the horizontal deflection axis is done without being influenced by the neck 16.

The convergence correcting device 30*a* is mounted on the deflection yoke 9 so as to be movable right and left without rotating about the tube axis or inclining (the device for this purpose is not shown herein).

Using the thus arranged convergence correcting device 30*a*, by correcting the XH axis deviation, the possible correction extent of the XH axis deviation, the changing amount of YV axis deviation, and changes of distortion (vertical and lateral pins and trapezoidal distortion) were measured, and as a result it is shown that the XH axis deviation could be corrected by a maximum of 0.8 mm, and the change of YV axis deviation was controlled within a practically ignorable level of 0.05 mm or less (nearly 0 mm).

Although measured data of distortion is not shown, changes were within 0.1% in both vertical and lateral pins and trapezoidal distortion.

As for the magnetic pieces 7*a*, 7*b* and magnetic pieces 10*a*, 10*b*, the size, position and moving range are not particularly defined, but may be properly determined depending on the correcting amount of the XH axis deviation, and canceling amount of the YV axis deviation change.

Basically, first the size, position and moving range of the magnetic pieces 7*a*,7*b* are determined to conform to the XH axis deviation correcting amount desired by the designer. Then, depending on the changing amount of the YV axis deviation to be canceled, the size and position of the magnetic pieces 10*a*, 10*b* should be determined.

This is the case of correction of XH axis deviation correction due to lateral imbalance of the distribution of horizontal deflection magnetic field, and when applied to correction of YV axis deviation due to lateral imbalance of distribution of vertical deflection magnetic field, contrary to the determining method above, first the size, position and moving range of the magnetic pieces 10*a*, 10*b* are determined to conform to the correction amount desired by the designer, and then the size and position of the magnetic pieces 7*a*, 7*b* are determined depending on the amount of XH axis deviation to be canceled. In such technique, as a matter of course, the YV axis deviation can be corrected while suppressing change of XH axis deviation.

Preferred embodiment 2

Figure 7:
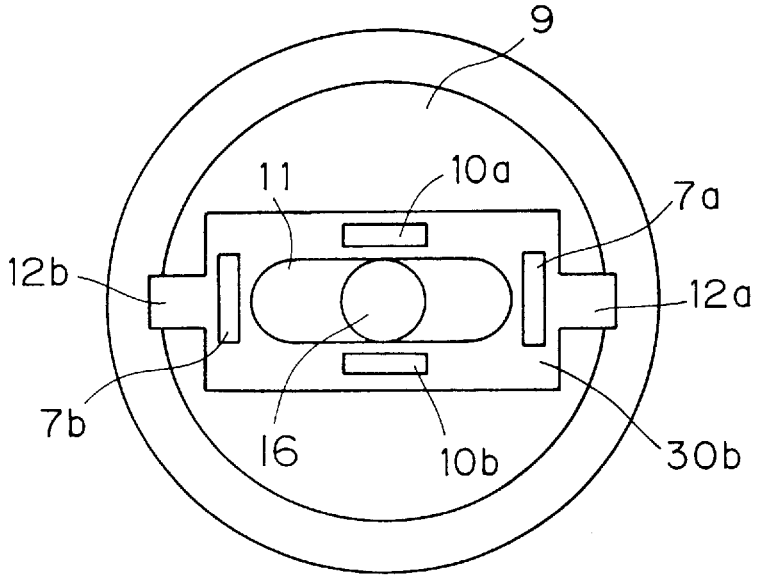
FIG. 7 is a front view showing a schematic arrangement of preferred embodiment 2 of the invention.

FIG. 7 shows a convergence correcting device 30*b* adding handles 12*a*, 12*b* to the convergence correcting device 30*a* holding the pair of magnetic pieces in preferred embodiment 1.

By employing such constitution, the convergence correcting device 30*b* can be moved easily, and the working efficiency enhanced.

The size, shape, mounting position, and number of handles 12*a*, 12*b* are not particularly defined, but may be properly determined depending on the working efficiency and available space or the like.

Preferred embodiment 3

Figure 8:
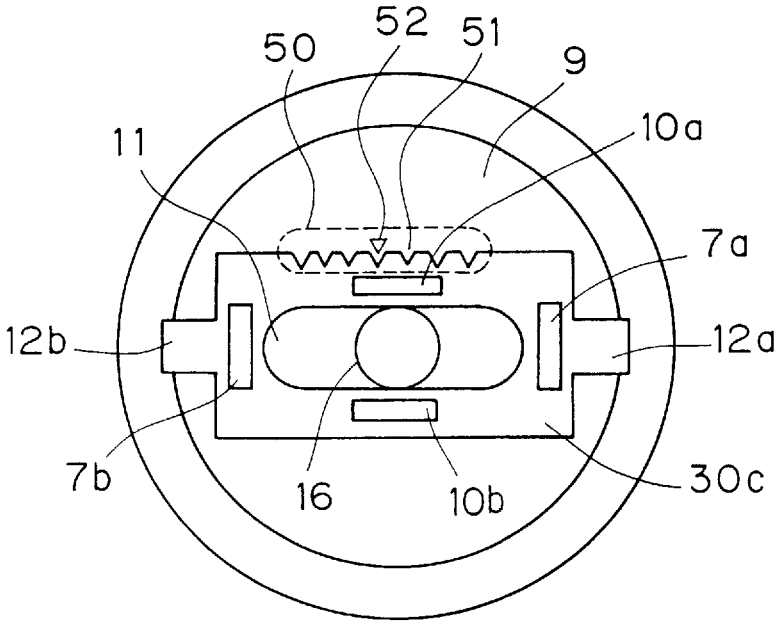
FIG. 8 is a front view showing a schematic arrangement of preferred Embodiment 3 of the invention.

FIG. 8 shows a convergence correcting device 30*c* adding fixing means 50 to the convergence correcting device, so as to be fixed at a desired position in the horizontal axial direction, in preferred embodiment 2.

The fixing means 50 is composed of plural notches or grooves 51 provided at the side of the convergence correcting device 30*c*, and locking members to be engaged with the notches or grooves 51.

The locking members 52 are pressed elastically to the notches or grooves 51 by a mechanism not shown herein, and therefore the convergence correcting device 30*c* can be moved in the horizontal deflection axial direction, and is fixed at a position where the locking members 52 are engaged with the notches or grooves 51.

According to this preferred embodiment, therefore, the convergence correcting device 30*c* can be fixed at an optimum position or its vicinity for correction of deviation of convergence, so that the working efficiency may be enhanced.

B. When correcting coil is wound on subsidiary yoke:

Preferred embodiment 4

Figure 9:
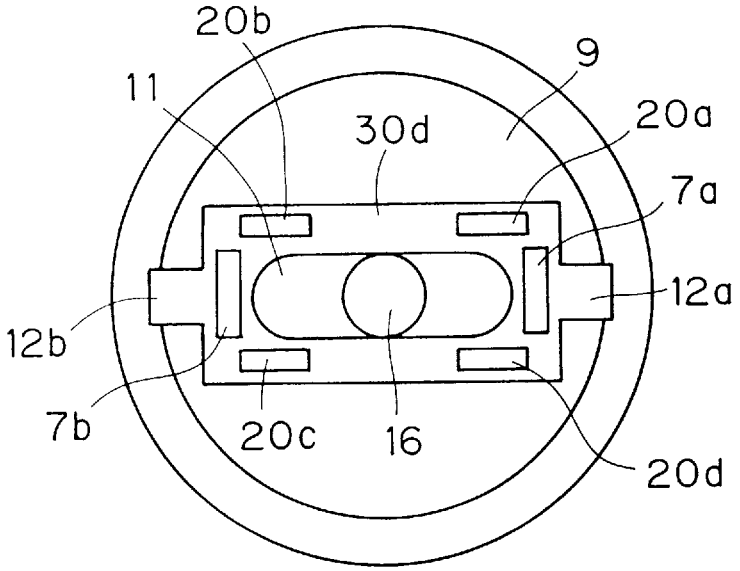
FIG. 9 is a front view showing a schematic arrangement of preferred embodiment 4 of the invention.
Figure 10:
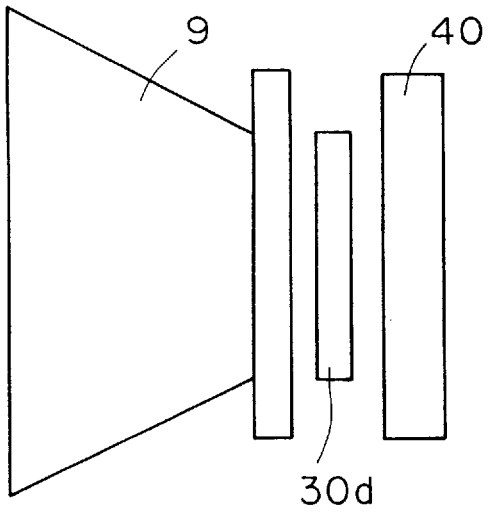
FIG. 10 is a side view showing a schematic arrangement of preferred embodiment 4 of the invention.

FIG. 9 is a front view showing a different preferred embodiment of a convergence correcting device according to the invention, being a schematic structural diagram as seen from the neck 16 side. FIG. 10 is a lateral view of the constitution shown in FIG. 9.

Prior to description of preferred embodiment 4 shown in FIG. 9 and FIG. 10, as an advance study for solving the problems of the background arts, as shown in FIG. 3A, it was investigated what would happen when only the pair of magnetic pieces 10*a*, 10*b* for correction YV axis deviation were disposed in the convergence correcting device 8 for the purpose of correction of XH axis deviation of the background arts (second preliminary stage art). Different from the preferred embodiment group A, the vertical coma correcting coil 42 is wound on the subsidiary yoke 41 as in the background art example two, and current is flowing.

Same as in the first preliminary stage art, the magnetic pieces lea, fob are disposed, and the convergence correcting device 8 movable right and left along the horizontal deflection axis is disposed at the electron gun side end of the deflection yoke 9.

Using the pair of magnetic pieces 10*a*, 10*b* made of silicon steel plate of 30×mm and 0.5 mm in thickness, the correcting effect of YV axis deviation was measured in the same conditions as in measurement of correcting effect of XH axis deviation shown in the background art 2 (the specification, configuration, and magnetic piece inserting position of 8-pole core 41), and the change as shown in FIG. 3C was obtained same as explained in the first preliminary stage art. Although not shown in the drawing, the XH axis deviation was also changed slightly.

However, since the correcting coil 41 is wound, the phenomenon in the second preliminary stage art is different from that of the first preliminary stage art. Comparison is made between the relation of change of YV axis deviation and moving direction of magnetic pieces 7*a*, 7*b* in correction of XH axis deviation, and the relation of change of YV axis deviation and moving direction of magnetic pieces 10*a*, 10*b* in cancellation of YV axis deviation. That is, comparing FIG. 23 and FIG. 3C, when the moving directions of magnetic pieces 7*a*, 7*b* and magnetic pieces 10*a*, 10*b* are the same, the changes of YV axis deviation are the same. Therefore, provision of magnetic pieces 10*a*, 10*b* causes to increase further the YV axis deviation, and hence the magnetic pieces 10*a*, 10*b* are judged to be improper as the means for canceling the YV axis deviation caused by correction of XH axis deviation done by the magnetic pieces 7*a*, 7*b*.

Incidentally, in the motion of the magnetic pieces 10*a*, 10*b* in correction of YV axis deviation correction shown in FIG. 3A, when the convergence correcting device 8 with the holding plate for holding the magnetic pieces 10*a*, 10*b* is moved from the symmetrical position (center of tube axis), the configuration is such that the magnetic pieces 10*a*, 10*b* are remote from the center of symmetricity. Therefore, when configured so that the magnetic pieces 10*a*, 10*b* may be closer to the center of symmetricity when the magnetic piece holding plate (that is, the convergence correcting device 8) is shifted from the symmetrical position, the change of YV axis deviation seems to be opposite to the case shown in FIG. 3C.

Figure 11:
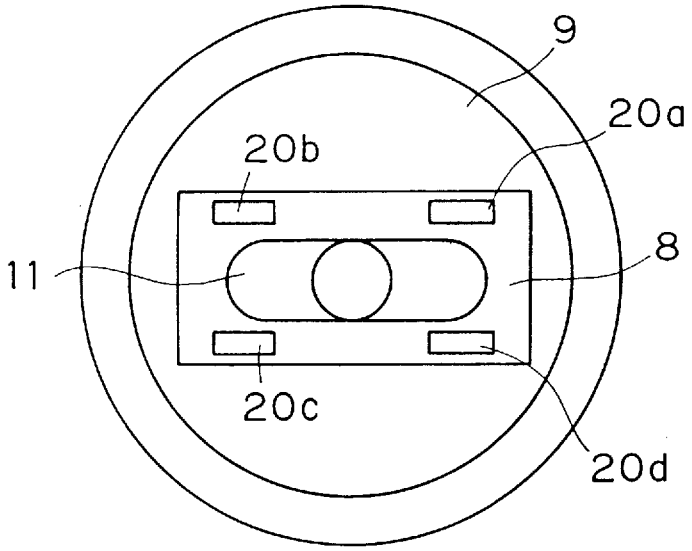
FIG. 11 is a front view showing a schematic arrangement of a second preliminary stage an FIG. 12 shows a changing state of deviation of convergence in the second preliminary stage an FIG. 13A to FIG. 13C show measuring modes of convergence deviation in the second preliminary stage am.

To realize such change of YV axis deviation, as shown in FIG. 11, four 20 magnetic pieces 20*a* to 20*d* are disposed to set the electron beams between two of them on diagonal lines, symmetrically to the vertical deflection axis and horizontal deflection axis. That is, the magnetic pieces 20*a*, 20*b* are arranged on a side parallel to the horizontal deflection axis, the magnetic pieces 20*c*, 20*d* are arranged on other side parallel to the horizontal deflection axis, the magnetic pieces 20*a*, 20*d* are arranged on a side parallel to the vertical deflection axis, and the magnetic pieces 20*b*, 20*c* are arranged on other side parallel to the vertical deflection axis. That is, the magnetic pieces 20*a* to 20*d* are arranged on each apex of a rectangle. If they are moved right and left along the horizontal deflection axis, the distance from the magnetic piece 20*a* to the electron gun and the distance from the magnetic piece 20*d* to the electron gun are equal to each other. Besides, the distance from the magnetic piece 20*b* to the electron gun and the distance from the magnetic piece 20*c* to the electron gun are also equal to each other.

The four magnetic pieces 20*a* to 20*d* are desired to be long in a direction along the vertical deflection magnetic field (along the horizontal deflection axis). This is for giving an effective effect on the vertical deflection magnetic field.

Incidentally, using the four magnetic pieces in the constitution in FIG. 11, the effect of canceling the YV axis deviation was investigated in the same conditions as in the measurement of correction effect of XH axis deviation shown in the background art 2 (the specification, configuration, and magnetic piece inserting position of the 8-pole core 41).

Figures 13A, 13B, 13C:
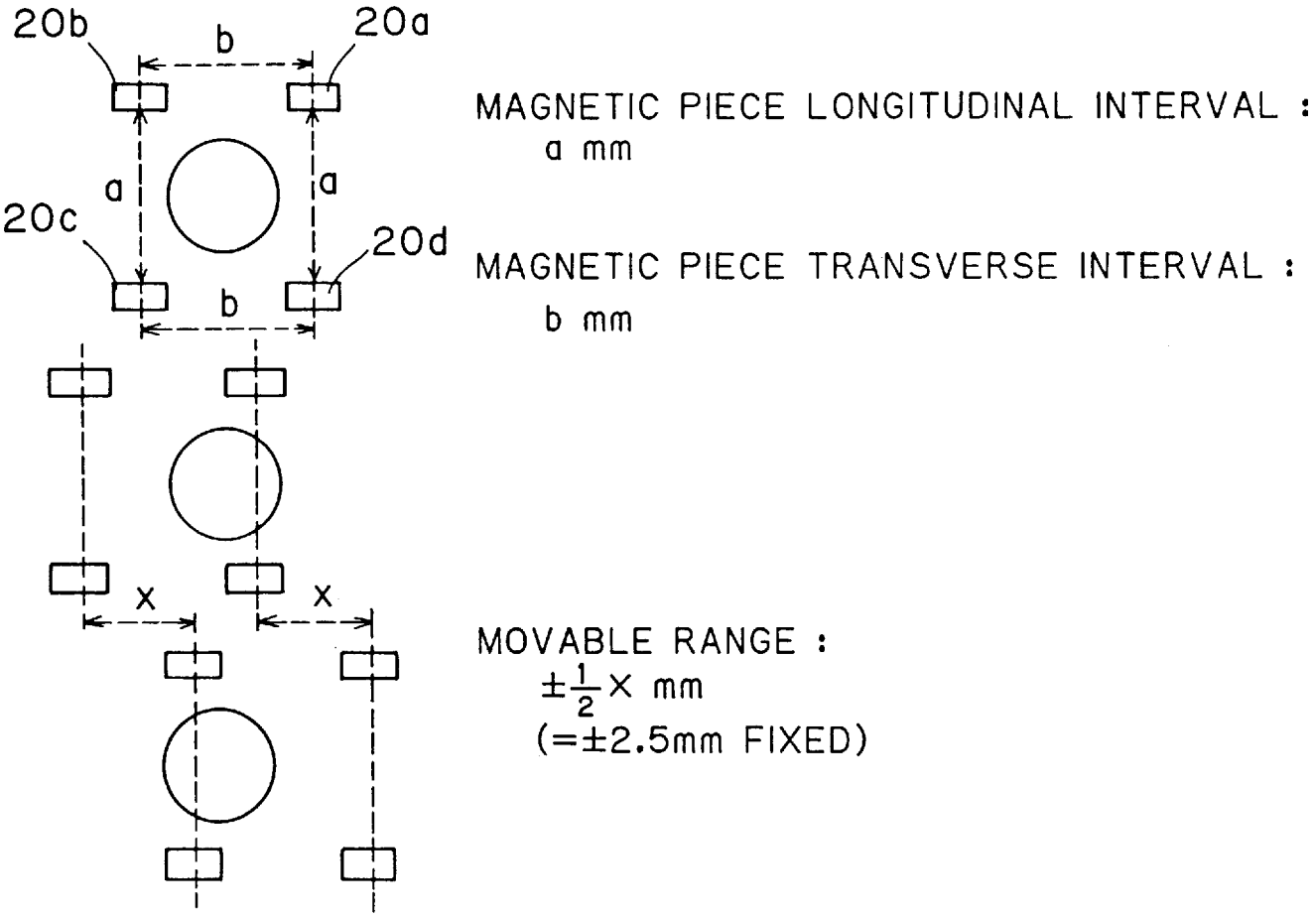
Figure 14:
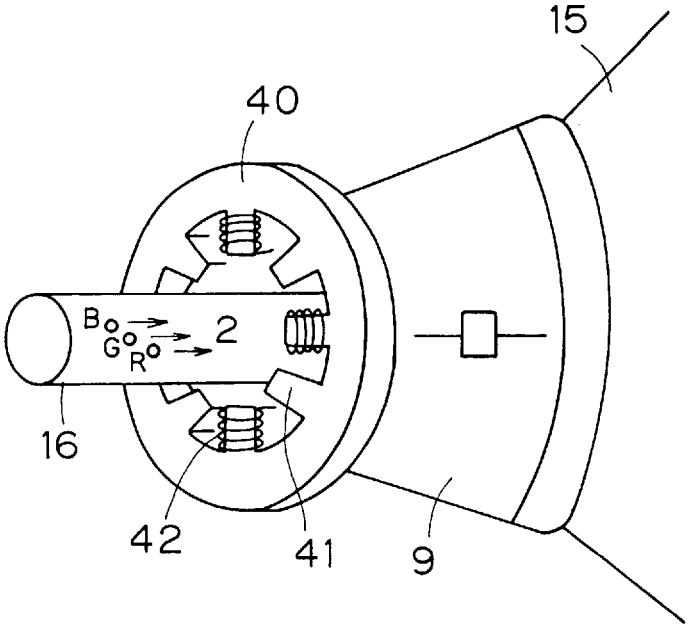
FIG. 14 PRIOR ART
FIG. 14 shows the arrangement of a background art example one.
Figure 15:
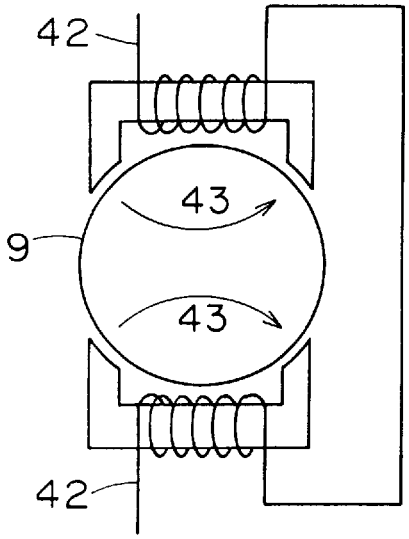
FIG. 15 PRIOR ART
FIG. 15 is a circuit diagram for explaining vernical coma correction.
Figure 16A:
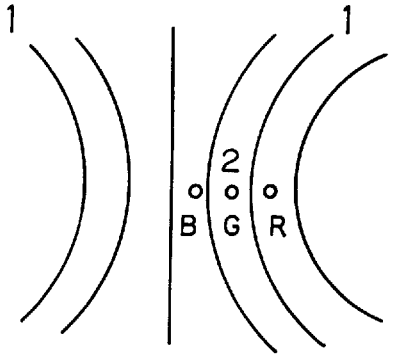
FIG. 16A PRIOR ART
FIG. 16A shows distribution of horizontal deflection magnetic field.
Figure 16B:
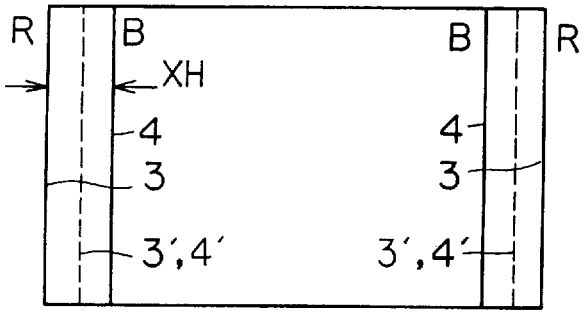
FIG. 16B PRIOR ART
FIG. 16B shows deviation of convergence in the background art example one.
Figure 17A:
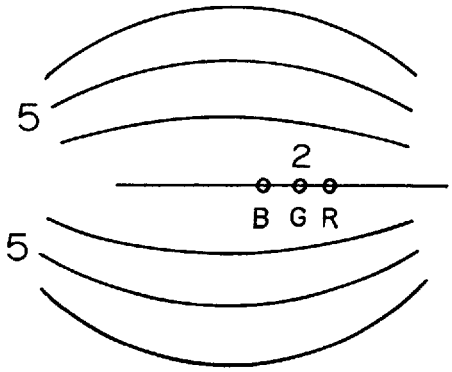
FIG. 17A PRIOR ART
FIG. 17A shows distribution of vertical deflection magnetic field.
Figure 17B:
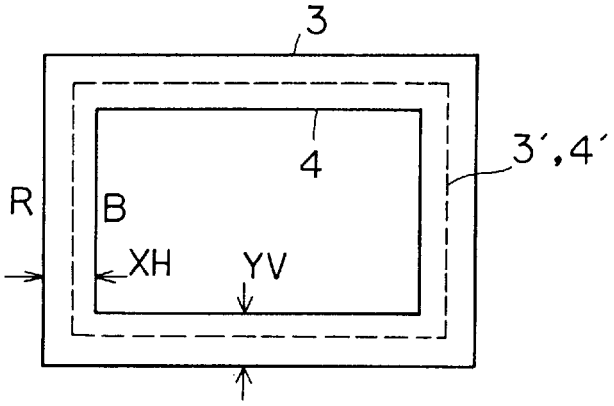
FIG. 17B PRIOR ART
FIG. 17B shows deviation of convergence in the background art example one.
Figure 17C:
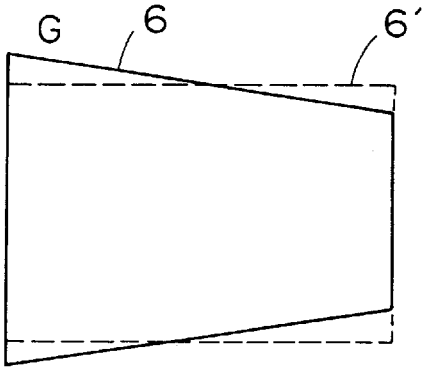
FIG. 17C PRIOR ART
FIG. 17C shows changes of distortion of raster in the background art example one.

The four magnetic pieces 20*a* to 20*d* for correction of YV axis deviation were made of silicon steel plate (15×3 mm, 0.5 mm thick), the movable range of the magnetic pieces was ±2.5 mm, and the parameters were the longitudinal interval a and transverse interval b of the magnetic pieces. Modes of measurement are 20 shown in FIGS. 13A to 13C, and results of measurement are recorded in Table 4. It is known from Table 4 that the canceling amount of the YV axis deviation tends to increase as the intervals a, b of the magnetic pieces are narrower.

TABLE 4

| | | Longitudinal Interval (a) | | | |
|---|---|---|---|---|---|
| Transverse Interval (a) | | 40 mm | 45 mm | 50 mm | 55 mm |
| 30 mm | YV | | 0.37 | 0.25 | |
| | XH | | 0.06 | 0.07 | |
| 35 mm | YV | 0.40 | 0.37 | 0.26 | 0.13 |
| | XH | 0.05 | 0.09 | 0.11 | 0.06 |
| 40 mm | YV | 0.14 | 0.12 | | |
| | XH | 0.01 | 0.06 | | |

Unit: mm

Figure 12:
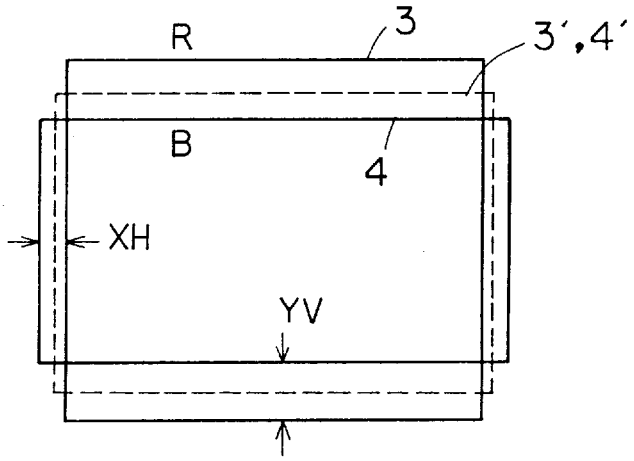

The change of YV axis deviation measured in the condition above is as shown in FIG. 12 when the magnetic pieces are moved to the right side as seen from the tube surface, for example, same as in FIG. 3B, and comparing FIG. 19 and FIG. 12, it known that the change of the YV axis deviation is in reverse direction when the direction of the electron beams in the moving direction of the magnetic pieces 7*a*,7*b* is matched with the moving direction of the four magnetic pieces 20*a* to 20*d* arranged in a rectangular form on the diagonal lines.

Therefore, as the means for canceling the change of the YV axis deviation, it is known effective to arrange the four correcting magnetic pieces in a rectangular form on diagonal lines to fold the electron beams in them as shown in FIG. 11.

Figure 25:
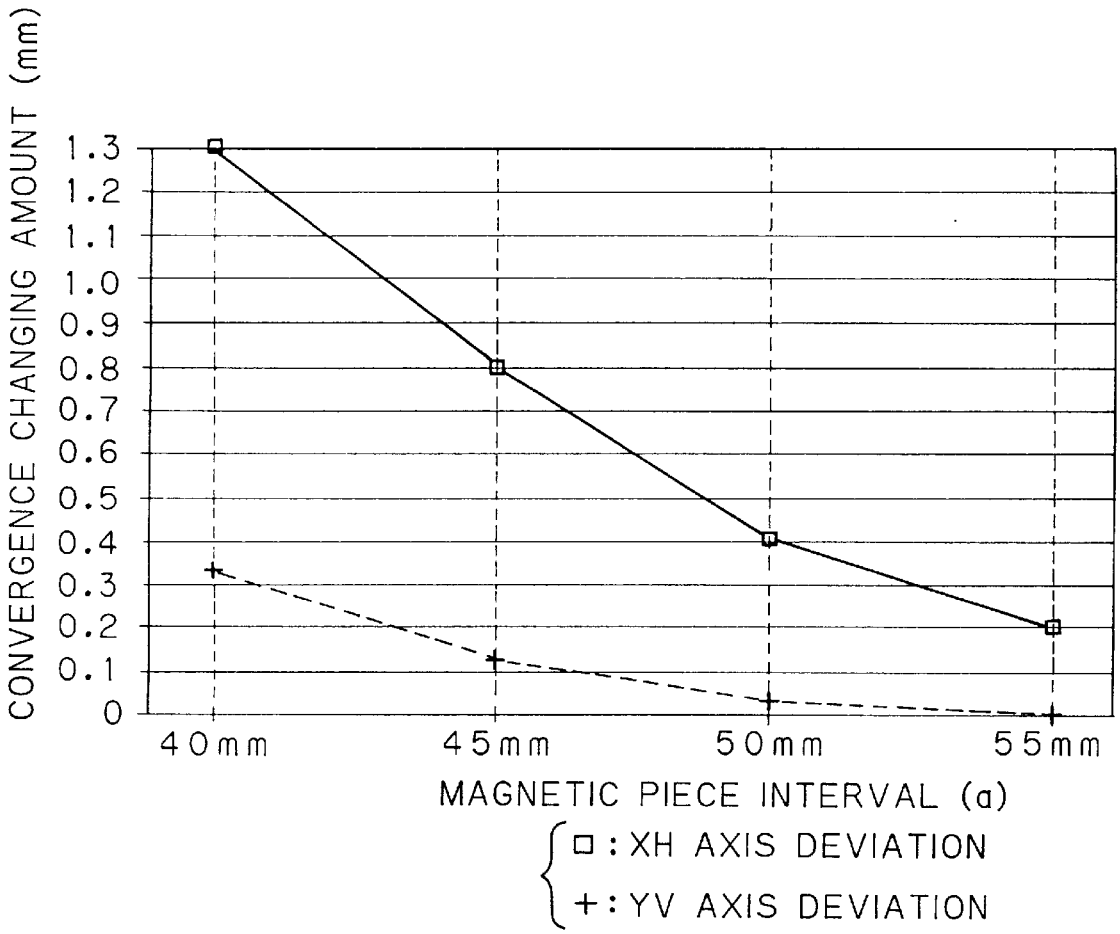
FIG. 25 PRIOR ART
FIG. 25 is a graph showing results of measurement of deviation of convergence in the background art example two.

Moreover, as clear from FIG. 12, the XH axis deviation is also changed, and its direction is the decreasing direction of the correction amount of the XH axis deviation. As evident from Table 2 and FIG. 25, the amount of YV axis deviation to be canceled occurring in order to obtain the necessary correction amount (0.8 mm) of the XH axis deviation is about 0.1 mm or more, and this is satisfied throughout in the measuring conditions above. Yet, the change of XH axis deviation occurring when canceling the YV axis deviation of this amount is about 0.1 mm or less as known from Table 4. Hence, there is no problem when the correction amount of the XH axis deviation is preliminarily set larger by this 10 decreasing amount.

Hence, in the deflection yoke 9 having the subsidiary yoke composed of a multipolar core for vertical coma correction provided in the rear part, it has been confirmed that the change of YV axis deviation caused by correction of the XH axis deviation by using the magnetic pieces 7*a*, 7*b* can be effectively canceled by disposing the four magnetic pieces 20*a* to 20*d* arranged to set the electron beams on diagonal lines symmetrically to the vertical deflection axis and horizontal deflection axis, and properly selecting the size and distance from the tube axis of the magnetic pieces 20*a* to 20*d*.

The preferred embodiment 4 of the invention is described by referring to FIG. 9 and FIG. 10. In FIG. 9, the pair of magnetic pieces 7*a*, 7*b* for correction of XH axis deviation, and four magnetic pieces 20*a* to 20*d* for canceling the change of YV axis deviation are arranged on the convergence correcting device 30*d*. The pair of magnetic pieces 7*a*, 7*b* are disposed to hold the electron beams on both sides on the horizontal deflection axis, and the magnetic pieces 20*a* to 20*d* are disposed to set the electron beams between two of them on diagonal lines, in a rectangular form at specified intervals in the vertical deflection axial direction and horizontal deflection axial direction.

In the convergence correcting device 30*d*, the neck 16 of the inline type color picture tube is inserted nearly in the middle, and a slot 11 long in the horizontal deflection axial direction is provided so as to be movable along the horizontal deflection axis.

FIG. 10 shows the configuration the deflection yoke 9, convergence correcting device 30*d*, and subsidiary yoke 40 with multipolar core for vertical coma correction of the preferred embodiment in the tube axial direction.

In the convergence correcting device 30*d* as shown in FIG. 9, supposing the possible correcting extent of the XH axis deviation to be 1.0 mm, if the movable range x of the magnetic pieces is too small, fine adjustment is difficult, and if too wide, it takes a wide area, and hence it was set at +2.5 mm.

To satisfy such conditions, judging from the results of measurement shown in Table 4, the magnetic pieces 7*a*,7*b* for correction of XH axis deviation were ferrite plates of 30×5 mm in size and 1 mm in thickness, disposed at an interval of 42 mm, and the four magnetic pieces 20*a* to 20*d* for cancellation of YV axis deviation were silicon steel plates of 15×3 mm in size and 0.5 mm in thickness, at a longitudinal interval of 40 mm and a transverse interval of 37 mm.

The fixing method of the magnetic pieces 7*a*, 7*b* and 20*a* to 20*d* on the convergence correcting device 30 is not specifically defined, but they should be fixed firmly.

The subsidiary yoke 40 composed of 8-pole core is disposed at the electron gun side from the convergence correcting device 30*d* as shown in FIG. 10, and the configuration is same as the measuring condition explained in the background art 2.

The location of the convergence correcting device 30*d* is not limited between the subsidiary yoke 40 and deflection yoke 9, but may be disposed at the electron gun side of the subsidiary yoke 40, and the same effects are obtained.

The size, position and moving range of the magnetic pieces 7*a*, 7*b*, 20*a* to 20*d* are not particularly defined, but may be determined properly depending on the correction amount of XH axis deviation and canceling amount of W axis deviation.

Basically, first the size, position and moving range of the magnetic pieces 7*a*,7*b* are determined to conform to the XH axis deviation correcting amount desired by the designer, and then, depending on the canceling amount of the W axis deviation, the size and position of the magnetic pieces 20*a* to 20*d* should be determined.

As for the magnetic pieces 7*a*, 7*b*, 20*a* to 20*d*, in order to minimize the increase of dimension of the convergence correcting device 30*d* holding them in the tube axial direction, a plate form is disposed parallel to the tube axis in the thickness direction.

As for the four magnetic pieces 20*a* to 20*d*, same as in the magnetic pieces lea, 10*b* in the preferred embodiment 1, silicon steel plates are extended in the direction along the vertical deflection magnetic field, and hence the W axis deviation can be canceled effectively and at low cost.

Furthermore, as shown in FIG. 9, by attaching handles 12*a*, 12*b* to the convergence correcting device 30*d*, same as in the preferred embodiment 2, the working efficiency is enhanced in correction of axial deviation of convergence by moving the convergence correcting device 30*d* in the horizontal direction. Of course, the size, shape, position and number of the handles are not particularly limited, but may be determined as required.

When the XH axis deviation is corrected by the use of the convergence correcting device 30*d* with the structure shown in FIG. 9, the possible correction amount of the XH axis deviation and the changing amount of the YV axis deviation are measured. At the same time, in correcting the XH axis deviation, influences on the misconvergences and the distortions at corners, axis ends and the center are measured as well. More specifically, the moving amount of B with respect to R (shown by R–>B in figure) and moving amount of G with respect to the middle point between R and B (RB–>G) are measured to see the influence on the misconvergences, while the changing amount of pin distortions in all directions and the changing amounts of trapezoidal distortions are measured to see the influence on distortions.

The results are shown in Table 5 and Table 6. As for XH axis deviation (moving amount of X axis end in X direction of R–>B), correction of 1.15 mm is possible, and on the other hand as for the W axis deviation (moving amount of Y axis end in Y direction of R–>B), it was canceled and suppressed to 0.05 mm or less (nearly 0 mm).

TABLE 5

| | R → B | | R/B → G | |
|---|---|---|---|---|
| | X | Y | X | Y |
| Center | −0.02 | −0.01 | 0.00 | −0.01 |
| Corner | 1.10 | −0.05 | −0.05 | 0.01 |
| X-axis End | 1.15 | 0.01 | −0.03 | 0.00 |
| Y-axis End | −0.02 | 0.04 | −0.01 | 0.01 |

Unit: mm
(Note 1)
Change of convergence correcting device 30d was moved from the leftmost side to the rightmost side as seen from the tube surface, averaged in four quadrants.
(Note 2)
R –> B: Moving (changing) amount of Blue with respect to Red
R/B –> G: Moving (changing) amount of Green with respect to middle point of Red and Blue Horizontal deflection axial direction on screen: Rightward in X-direction is + (plus).

Vertical deflection axial direction on screen: Upward in Y-direction is + (plus).

TABLE 6

| | Magnetic Piece Position | | |
|---|---|---|---|
| Type of Distortion | Leftmost as seen from tube side | Neutral Position | Rightmost as seen from tube side |
| Vertical Pin Distortion | 0.28 (−0.02) | 0.30 | 0.20 (−0.10) |
| Lateral Pin Distortion | 0.30 (+0.03) | 0.37 | 0.35 (−0.02) |
| Vertical Trapezoidal Distortion | 0.41 (+0.02) | 0.39 | 0.37 (−0.02) |
| Lateral Trapezoidal Distortion | 0.11 (+0.00) | 0.11 | 0.09 (−0.02) |

( ) Change from neutral position
Unit: %

Concerning distortion, the change was within 0.1% in both vertical and lateral pins and trapezoidal distortion. The distortion shown in Table 6 was measured according to the standard ED-2101J of Electronic Industrial Association of Japan (EIAJ). This result was sufficiently satisfactory in practical use.

While the invention has been shown and described in detail, the foregoing description is in all aspects illustrative and not restrictive. It is therefore understood that numerous modifications and variations can be devised without departing from the scope of the invention.

I claim:

1. A convergence correcting device for correcting convergence of a color image display device comprising:

a color picture tube, having an inline type electron gun for generating three electron beams along a horizontal deflection axis:

a deflection yoke for deflecting said three electron beams along said horizontal deflection axis and a vertical deflection axis;

a subsidiary yoke, composed of a multipolar core, disposed at said electron gun side of said deflection yoke;

a first pair of magnetic pieces, movable along said horizontal deflection axis, while mutually keeping a first interval, aligned with said electron gun on said horizontal deflection axis;

a second pair of magnetic pieces, movable along said horizontal deflection axis, while mutually keeping a second interval, aligned on said vertical deflection axis; and a base body on which said first pair of magnetic pieces are mounted at said first interval, and said second pair of magnetic pieces are mounted at said second interval, said base body being movable along said horizontal deflection axis;

wherein two distances from one and the other of said second pair of magnetic pieces to said electron gun are equal, if moving along said horizontal deflection axis, so that a relative configuration of said first and second pairs of magnetic pieces may be maintained.

2. The convergence correcting device of claim 1, further comprising:

a handle attached to said base body.

3. The convergence correcting device of claim 2, further comprising:

fixing means for fixing said base body at a desired position in a moving range along said horizontal deflection axis.

4. The convergence correcting device of claim 1, wherein said first pair of magnetic pieces are composed of ferrite material.

5. The convergence correcting device of claim 1, wherein said second pair of magnetic pieces are composed of silicon steel plate.

6. The convergence correcting device of claim 1, wherein said first pair of magnetic pieces are long along said vertical deflection axis.

7. The convergence correcting device of claim 1, wherein said second pair of magnetic pieces are long along said horizontal deflection axis.

8. The convergence correcting device of claim 1, wherein said convergence correcting device is disposed between said deflection yoke and said subsidiary yoke.

9. A convergence correcting device for correcting convergence of a color image display device, comprising:

a color picture tube, having inline type electron gun for generating three electron beams along a horizontal deflection axis;

a deflection yoke for deflecting said three electron beams along said horizontal deflection axis and a vertical deflection axis;

a subsidiary yoke, disposed of a multipolar core, disposed at said electron gun side of said deflection yoke, wherein a vertical coma correcting coil is wound on said subsidiary yoke;

a pair of magnetic pieces, movable along said horizontal deflection axis while mutually keeping a specific interval, aligned with said electron gun on said horizontal deflection axis;

a set of four magnetic pieces, moveable along said horizontal deflection axis, being disposed on each apex of a rectangle having a first pair of sides parallel to said vertical deflection axis, and a second pair of sides parallel to said horizontal deflection axis; and a base body on which said pair of magnetic pieces are mounted at said specific interval, wherein said base body is movable along said horizontal deflection axis and said set of magnetic pieces are mounted at a position of each peak of said rectangle;

wherein two distances from one and the other of said set of magnetic pieces disposed at both ends of each of said first sides to said electron gun are mutually equal, if moving along said horizontal deflection axis, so that a relative configuration of said pair of magnetic pieces and said set of magnetic pieces may be maintained.

10. The convergence correcting device of claim 9, further comprising:

a handle attached to said base body.

11. The convergence correcting device of claim 9, wherein said pair of magnetic pieces are composed of ferrite material.

12. The convergence correcting device of claim 9, wherein said set of magnetic pieces are composed of silicon steel plate.

13. The convergence correcting device of claim 9, wherein said pair of magnetic pieces are long along said vertical deflection axis.

14. The convergence correcting device of claim 9, wherein said set of magnetic pieces are long along said horizontal deflection axis.

15. The convergence correcting device of claim 9, wherein said convergence correcting device is disposed between said deflection yoke and said subsidiary yoke.

* * * * *